US007061191B2

(12) United States Patent
Chitta

(10) Patent No.: US 7,061,191 B2
(45) Date of Patent: Jun. 13, 2006

(54) SYSTEM AND METHOD FOR REDUCING FLICKER OF COMPACT GAS DISCHARGE LAMPS AT LOW LAMP LIGHT OUTPUT LEVEL

(75) Inventor: Venkatesh Chitta, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/630,995

(22) Filed: Jul. 30, 2003

(65) Prior Publication Data

US 2005/0023997 A1 Feb. 3, 2005

(51) Int. Cl.
*H05B 37/00* (2006.01)

(52) U.S. Cl. ..... 315/307; 315/308; 315/DIG. 4

(58) Field of Classification Search ..... 315/307, 315/308, DIG. 4

See application file for complete search history.

(56) References Cited

U.S. PATENT DOCUMENTS 5,041,763 A 8/1991 Sullivan et al. ..... 315/176
5,041,763 A 6/1996 Sullivan et al. ..... 315/176
5,757,142 A * 5/1998 Kong ..... 315/224
5,841,239 A 11/1998 Sullivan et al. ..... 315/219
5,864,212 A 1/1999 Sullivan ..... 315/205
6,111,368 A 8/2000 Luchaco ..... 315/307
6,225,760 B1 5/2001 Moan ..... 315/360

* cited by examiner

*Primary Examiner*—David Vu
(74) *Attorney, Agent, or Firm*—Woodcock Washburn LLP

(57) ABSTRACT

A lamp lighting system allows dimming of a compact gas discharge lamp to a low light output level without perceptible flicker. When the system receives a request to dim the lamp to the low level, the lamp is operated at an intermediate output level prior to operating the lamp is then requested low level. When the lamp cools to below a threshold temperature, the lamp is then operated at the requested low level. In one embodiment, the lamp is dimmed from its full rated output level to 1% of its full rated output level. The intermediate level is approximately 2% to 5% of this full rated level. No flicker is perceived when the lamp level is reduced from the full rated level to the low level. Upon cooling, no flicker and no change in output level are perceived when the lamp is subsequently reduced from the intermediate level to the low level.

22 Claims, 6 Drawing Sheets

(3b)

(3 a)

SYSTEM AND METHOD FOR REDUCING FLICKER OF COMPACT GAS DISCHARGE LAMPS AT LOW LAMP LIGHT OUTPUT LEVEL

FIELD OF THE INVENTION

The present invention generally relates to dimming gas discharge lamps and ballasts, and more particularly to reducing flicker when dimming a compact gas discharge lamp to a low lamp light output level.

BACKGROUND OF THE INVENTION

A typical gas discharge light fixture includes a ballast and a gas discharge lamp. The ballast converts standard line voltage and frequency to a voltage and frequency suitable for the specific type of lamp. The gas discharge lamp converts electrical energy into visible light with high efficiency. Various forms of gas discharge light fixtures exist, for example, a single ballast may be coupled to several lamps or several ballasts may be coupled to several lamps.

Conventional gas discharge lamps are generally straight elongated tubes of essentially circular cross section with varying outside diameters ranging between about five-eighths and one and one-half inches. Compact gas discharge lamps differ from conventional gas discharge lamps in that they are constructed of smaller diameter tubing, typically having an outside diameter of less than about five-eighths of an inch. Also, the lamps are compact in part because the tubing has one or more small radius bends that allow the tube to fold back on itself in such a manner as to achieve a compact shape. Additionally, in compact gas discharge lamps wherein the tube is folded back on itself, the lamp ends typically are in close proximity to each other.

Compact gas discharge lamps and ballasts are generally designed to operate within specified temperatures. The specified temperatures are dependent upon the output level of the light being provided by the lamp. For example, a compact gas discharge lamp operating at its full rated light output level, referred to as its nominal light output level, is designed to operate at greater temperatures than a compact gas discharge lamp operating at 1% of its nominal light output level. If the gas discharge lamp is operated at a low output light level at too high a temperature, the light tends to flicker.

This phenomenon is particularly noticeable when dimming a compact gas discharge lamp from its nominal light output level to a low light output level, such as 1% of its nominal level. The flicker can be annoying. Further, the flicker could be interpreted as a malfunction in the lamp, the ballast, or other associated component of the lighting system.

Accordingly, there is a lighting system capable of providing stable, flicker-free light when dimming a compact gas discharge lamp to below about one percent of the lamp's nominal light output level.

SUMMARY OF THE PRESENT INVENTION

A compact gas discharge lighting system in accordance with the present invention includes a gas discharge lamp and ballast for controlling the gas discharge lamp. The system provides a mechanism for dimming the compact gas discharge lamp to a low light output level without perceptible flicker. In an exemplary embodiment of the invention, this is accomplished by operating the compact gas discharge lamp at an intermediate light output level prior to operating the compact gas discharge lamp at the low light output level. Upon receiving a request to dim the compact gas discharge lamp to the low light output level from its nominal lamp light output level, the ballast controls the gas discharge lamp to provide light at an intermediate light output level until the temperature of the compact gas discharge lamp drops below a threshold temperature. Upon cooling, the compact gas discharge lamp is operated at the low lamp light output level.

BRIEF DESCRIPTION OF THE DRAWING

The features and advantages of the present invention will be best understood when considering the following description in conjunction with the accompanying drawings, it being understood, however, that the invention is not limited to the specific methods and instrumentalities disclosed. In the drawings.

DETAILED DESCRIPTION OF EXEMPLARY EMBODIMENTS

Figure 1:
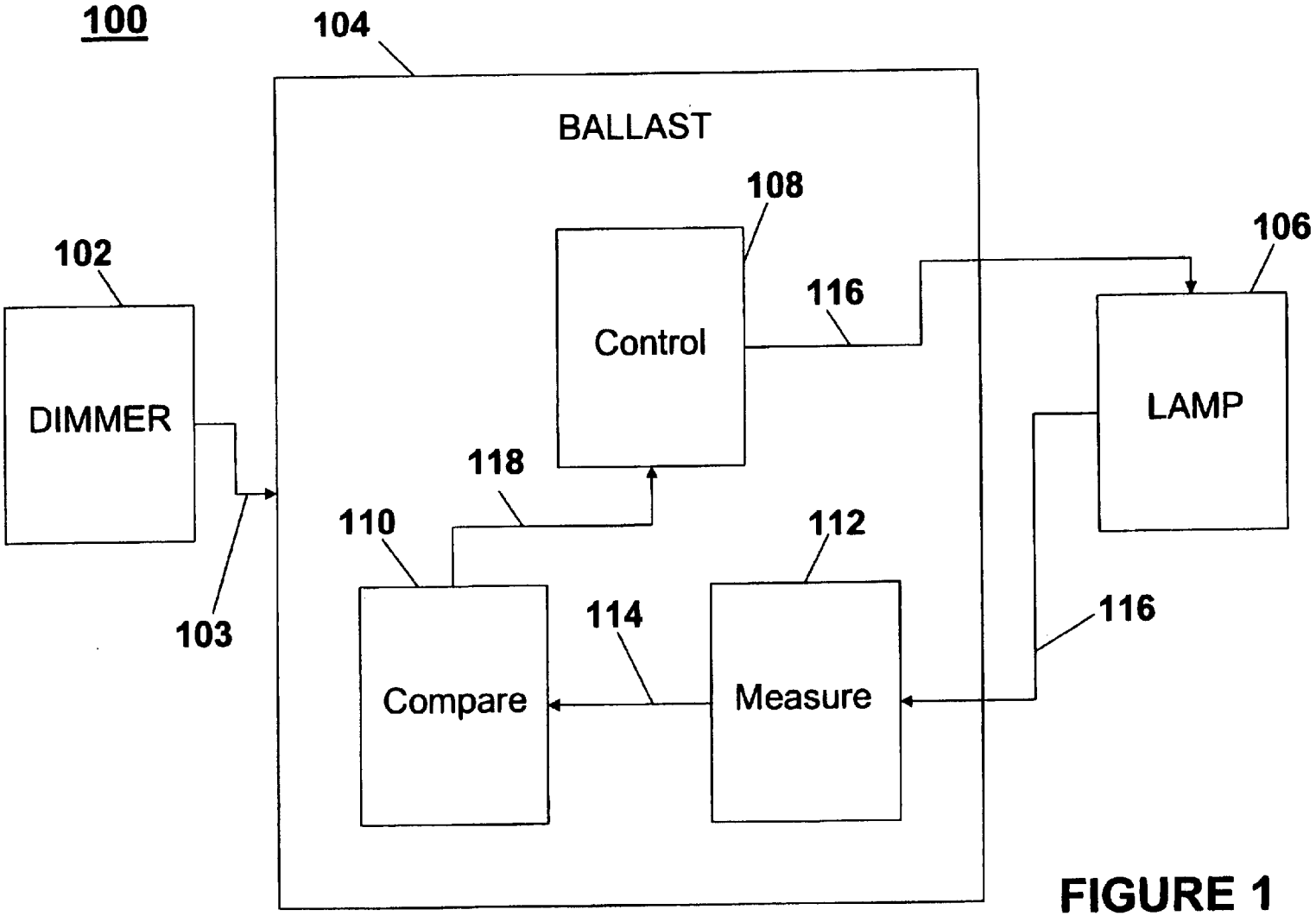
FIG. 1 is a high-level block diagram of lamp system for providing stable, flicker free dimming of a gas discharge lamp when the lamp light output level if reduced to a low light output level in accordance with an exemplary embodiment of the present invention.

A lighting system comprising a gas discharge lamp and ballast in accordance with the present invention provides a mechanism for dimming the compact gas discharge lamp to a low light output level without perceptible flicker. In one embodiment of the invention, this is accomplished by operating the compact gas discharge lamp at an intermediate light output level prior to operating the compact gas discharge lamp at the low light output level. For example, upon receiving a request to dim the compact gas discharge lamp to 1% of its nominal output light level, the ballast controls the lamp to provide light within a range of approximately 2% to 5% of the compact gas discharge lamp's nominal light output level until the temperature of the compact gas discharge lamp fixture drops below a threshold temperature. Because the lamp temperature does not change instantaneously, the lamp is operating at the intermediate light output level at a higher than rated temperature. However, no flicker is perceptible at the intermediate light output level at the higher temperature. Upon cooling, the compact gas discharge lamp is operated at the low light output level. Because the temperature is lower, the light does not flicker at the low light output level. Furthermore, no perceptible difference is noticed between dimming the lamp from its nominal light output level to the intermediate light output level and dimming the lamp from its nominal light output level to the low light output level. Once the lamp has cooled to the threshold temperature, dimming the lamp from the intermediate light output level to the low light output level also is not perceptible. The overall result is a compact gas discharge lamp and ballast system that can be dimmed from its nominal light output level to a low light output level (e.g., approximately 1% of its nominal level) with no perceivable flicker. To better understand the present invention, a description of electronic dimming ballasts for compact fluorescent lamps can be found in pending patent, application Ser. No. 10/160,546, filed on Jun. 1, 2002, U.S. Pat. No. 6,642,669, titled "ELECTRONIC DIMMING BALLAST FOR COMPACT FLUORESCENT LAMPS", which is hereby incorporated by reference in its entirety.

Generally, a gas discharge lamp is an elongated gas-filled (usually low-pressure mercury vapor) tube having electrodes at each end. Each electrode is typically formed from a resistive filament (usually tungsten) coated with a thermionically emissive material, such as a mixture of alkaline earth oxides. During typical steady-state operation of a gas discharge lamp, a voltage is applied across the resistive filaments, heating the electrodes to a temperature sufficient to cause thermionic emission of electrons into the discharge tube. A voltage applied between the electrodes accelerates the electrons toward the anode. En route to the anode, the electrons collide with gas atoms to produce positive ions and additional electrons, forming in the tube a gas plasma of positive and negative charge carriers. The electrons continue to stream toward the anode and the positive ions toward the cathode, sustaining an electric discharge in the tube and further heating the electrodes. If the applied power is AC, the electrodes reverse polarity each half cycle.

The discharge causes the emission of radiation having a wavelength dependent upon the particular fill gas and the electrical parameters of the discharge. Because each collision produces additional electrons and ions, increases in the arc current cause the impedance of the lamp to decrease, a characteristic known as "negative incremental impedance." Operation of the lamp is inherently unstable, due to this negative incremental impedance characteristic, and thus the current between the electrodes is controlled to provide stable operation of the lamp.

Gas discharge lamps, including fluorescent lamps, are designed to deliver their full rated, or "nominal", light output at a specified RMS lamp current value. Fluorescent gas discharge lamps include a phosphor coating on the inside surface of the tubular glass housing, and the excitation of this coating by radiation from the discharge provides the visible light output. Conventional fluorescent lamps are generally straight elongated tubes of essentially circular cross section with varying outside diameters ranging between about five-eighths and one and one-half inches.

As described previously, compact fluorescent lamps differ from conventional fluorescent lamps in that they are constructed of smaller diameter tubing, typically having an outside diameter of less than about five-eighths of an inch, the tubing has one or more small radius bends that allow the tube to fold back on itself in such a manner as to achieve a compact shape, and where the tube is folded back on itself, the lamp ends typically are in close proximity to each other.

FIG. 1 is a high level block diagram of a system 100 for providing stable, flicker free dimming of a gas discharge lamp when the lamp light output level if reduced to a low light output level in accordance with an exemplary embodiment of the present invention. The system 100 includes a lamp 106, a dimmer 102, and a ballast 104. The ballast 104 includes a control portion 108, a measure portion 112, and a compare portion 110. The dimmer 102 is utilized to provide a request to the ballast 104 to dim the lamp 106 to a low light output level (e.g., 1% of the lamp's nominal light output level). When the ballast 104 receives the request to dim the output light level of the lamp 106 from the dimmer 102 via dimmer signal 103, the measure portion 112, measures (or infers) the temperature of the lamp 106 via measurement signal 116. The measure portion 112 can measure the temperature of the lamp 106 via a temperature sensor (not shown in FIG. 1), or infer the temperature of the lamp 106 from measured values of lamp arc current, lamp arc voltage, lamp arc power (a function of lamp arc current and lamp arc voltage), or a combination thereof. A signal 114 indicative of the temperature of the lamp 106 is provided to the compare portion 110 by the measure portion 112. The compare portion 110 compares the value of the measured (or inferred) temperature of the lamp 106 with a threshold temperature value. The compare portion 110 provides a compare signal 118 indicative of the results of the comparison to the control portion 108. If the temperature of the lamp 106 is greater than or equal to the threshold temperature value, then the control portion 108 operates the lamp 106 at an intermediate light output level, which is greater than the requested low light output level. If the temperature of the lamp 106 is less than the threshold temperature value, then the control portion 108 operates the lamp 106 at the requested low light output level. In operation, a request to dim the lamp 106 to the low light output level is received by the ballast 104. If the temperature of the lamp is determined to be greater than the threshold temperature, the lamp is operated at the intermediate light output level until the lamp cools below the threshold temperature value. Thereafter, the lamp 106 is operated at the requested low light output level.

Figure 2:
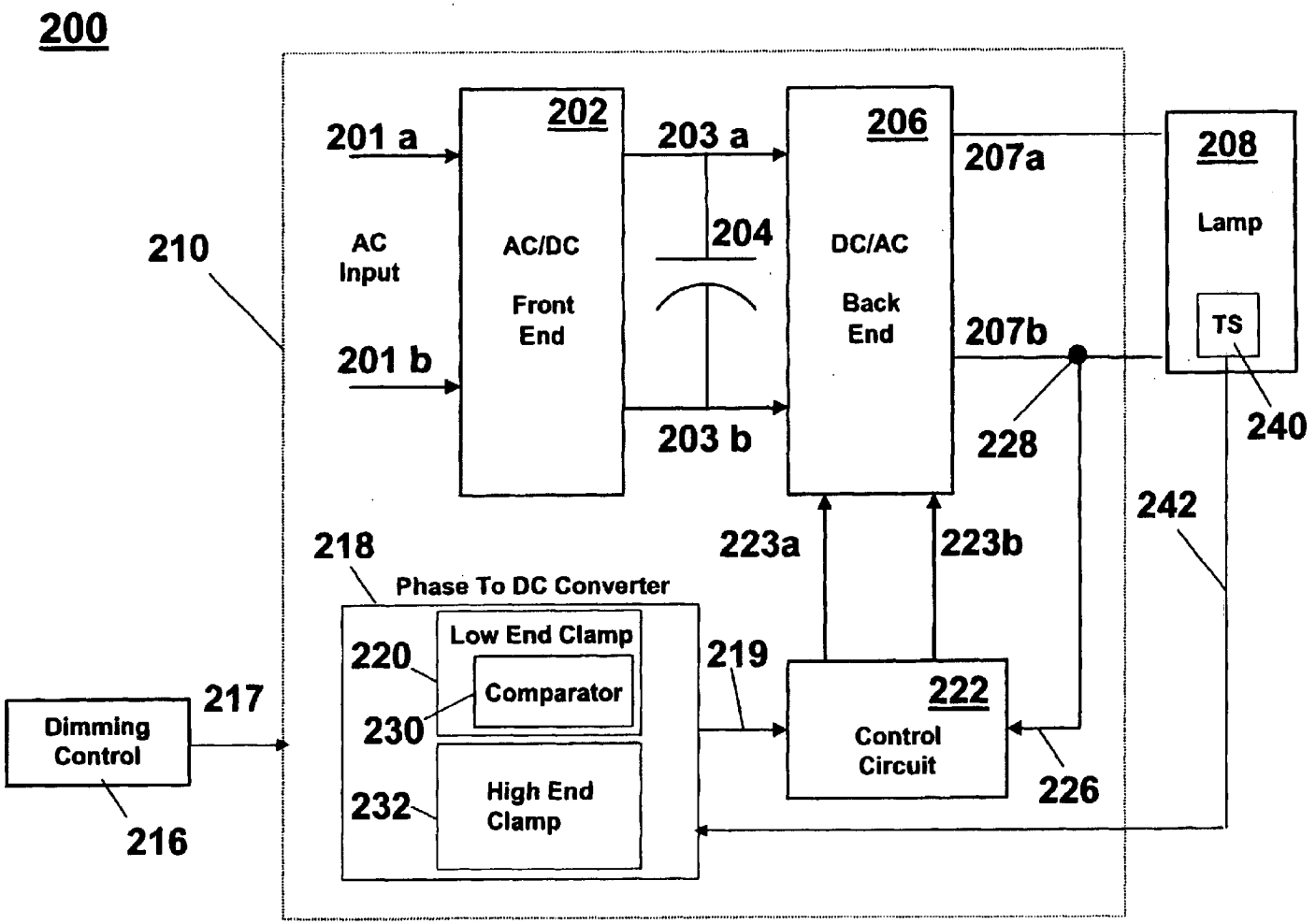
FIG. 2 is a block diagram of an exemplary system including a gas discharge lamp and a ballast in accordance with an exemplary embodiment of the present invention.

FIG. 2 is a block diagram of an exemplary system 200 including a gas discharge lamp 208 and a ballast 210 for providing stable, flicker free dimming of the gas discharge lamp 208 in accordance with an embodiment of the present invention. The ballast 210 includes a front end AC to DC converter 202 that converts applied line voltage 201*a*, 201*b*, typically 220 volts AC, 60 Hz, to a higher voltage, typically 400 to 500 volts DC. Capacitor 204 stabilizes the high voltage output on 203*a*, 203*b* of AC to DC converter 202. The high voltage across capacitor 204 is presented to a back end DC to AC converter 206, which typically produces a 100 to 400 Volt AC output at 45 KHz to 80 KHz at terminals 207*a*, 207*b* to drive the load 208, typically one or more gas discharge lamps. The voltage provided to the lamp 208 by the ballast 210 via terminals 207*a*, 207*b*, is referred to as the lamp arc voltage, and the current provided to the lamp 208 by the ballast 210 via the terminals 207*a*, 207*b* is referred to as the lamp arc current. It is to be understood that the present invention is application to gas discharge lamps in general, and a particular embodiment of which includes fluorescent lamps. Thus, the portions of the herein description pertaining to fluorescent lamps should not be construed as limiting applications of the present invention thereto.

Figure 3:
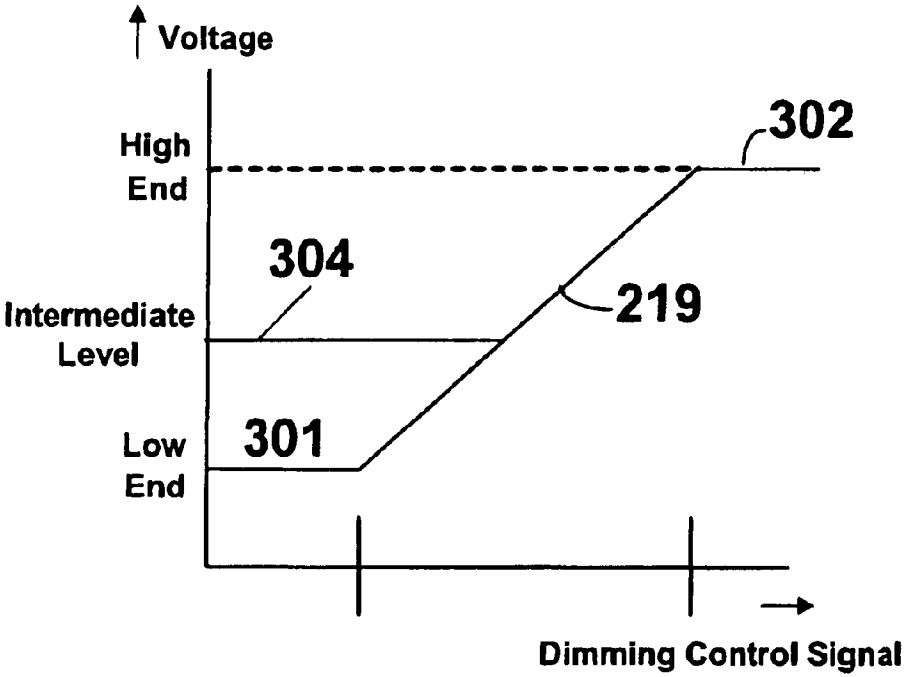
FIG. 3*a* illustrates a phase control output of a dimming control signal in accordance with an exemplary embodiment of the present invention.
FIG. 3*b* illustrates the low, intermediate, high, and linear regions of a DC voltage signal used to control the light output level of a gas discharge in accordance with an exemplary embodiment of the present invention.
Figure 3:
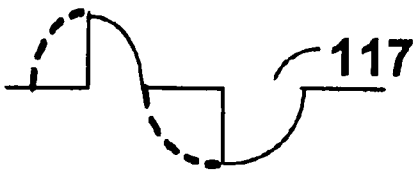

The system 200 also includes phase to DC converter 218, low end clamp 220, comparator 230, and high end clamp 232 that permit the ballast 210 to respond to a dimming signal 217 from a dimming control 216. The dimming control 216 can be any phase controlled dimming device and can be wall mountable. The dimming signal 217 is a phase controlled signal, of the type shown in FIG. 3*a*, such that the RMS voltage of the dimming signal varies with adjustment of the dimming actuator of dimming control 216. Dimming signal 217 drives a phase to DC converter 218 that converts the phase controlled dimming signal 217 to a DC voltage signal 219, as graphically shown in FIG. 3*b*. It will be seen that the signal 219 generally linearly tracks the dimming signal 217. However, clamping circuits 220, 232 modify this generally linear relationship as described herein below.

The signal 219 drives control circuit 222 to generate switching control signals 223*a*, 223*b*. The switching control signals 223*a*, 223*b* control the opening and closing of switches in the back end DC to AC converter 206. A current sense device 228 provides an output (load) current feedback signal 226 to the control circuit 222. The duty cycle, pulse width and/or frequency of the switching control signals is varied in accordance with the level of the signal 219 (subject to clamping by the circuits 220, 230, 232), and the feedback signal 226, to determine the output voltage and current delivered by the ballast 210 to the lamp 208.

The high end clamp circuit 232, the low end clamp circuit 220, and the comparator 230 in the phase to DC converter 218 limit the voltage output of the signal 219 of the phase to DC converter 218, which in turn limits the lamp light output level provided by the lamp 208. The effect of the high end clamp 232 and low end clamp 220 on the signal 219 is graphically shown in FIG. 3*b*. The high and low end clamps 232, 220 clamp the upper and lower ends of the otherwise linear signal 219 at levels 302 and 301, respectively. Thus, the high and low end clamps 232, 220 establish minimum and maximum dimming levels of the lamp 208.

Further, as described below, the comparator 230 limits the low end of the signal 219 to the intermediate level 304 when the temperature of the lamp is equal to or greater than a threshold temperature value. The temperature of the lamp 208 is provided by optional temperature sensor (TS) 240 via temperature sense signal 242. Thus, when the temperature of the lamp 208 is equal to or greater than a threshold temperature value, the low end value of the signal 219 is the limited to the intermediate value 204. When the temperature of the lamp 208 is less than the threshold temperature value, the low end value of the signal 219 is limited to the low end value 301. It is to be understood that the placement of the temperature sensor 240 as depicted in FIG. 2 is exemplary. The temperature sensor 240 can be positioned at any appropriate location, such that the temperature of the lamp can be measured. Examples of appropriate locations include within the ballast 210, within the lamp 208, proximate the ballast 210, proximate the lamp 208, or a combination thereof (e.g., multiple temperature sensors can be utilized). The use of the temperature sensor 240 is optional. As described below, the temperature of the lamp 208 can be inferred from other lamp parameters, such as the lamp arc voltage and the lamp arc current.

Figure 4:
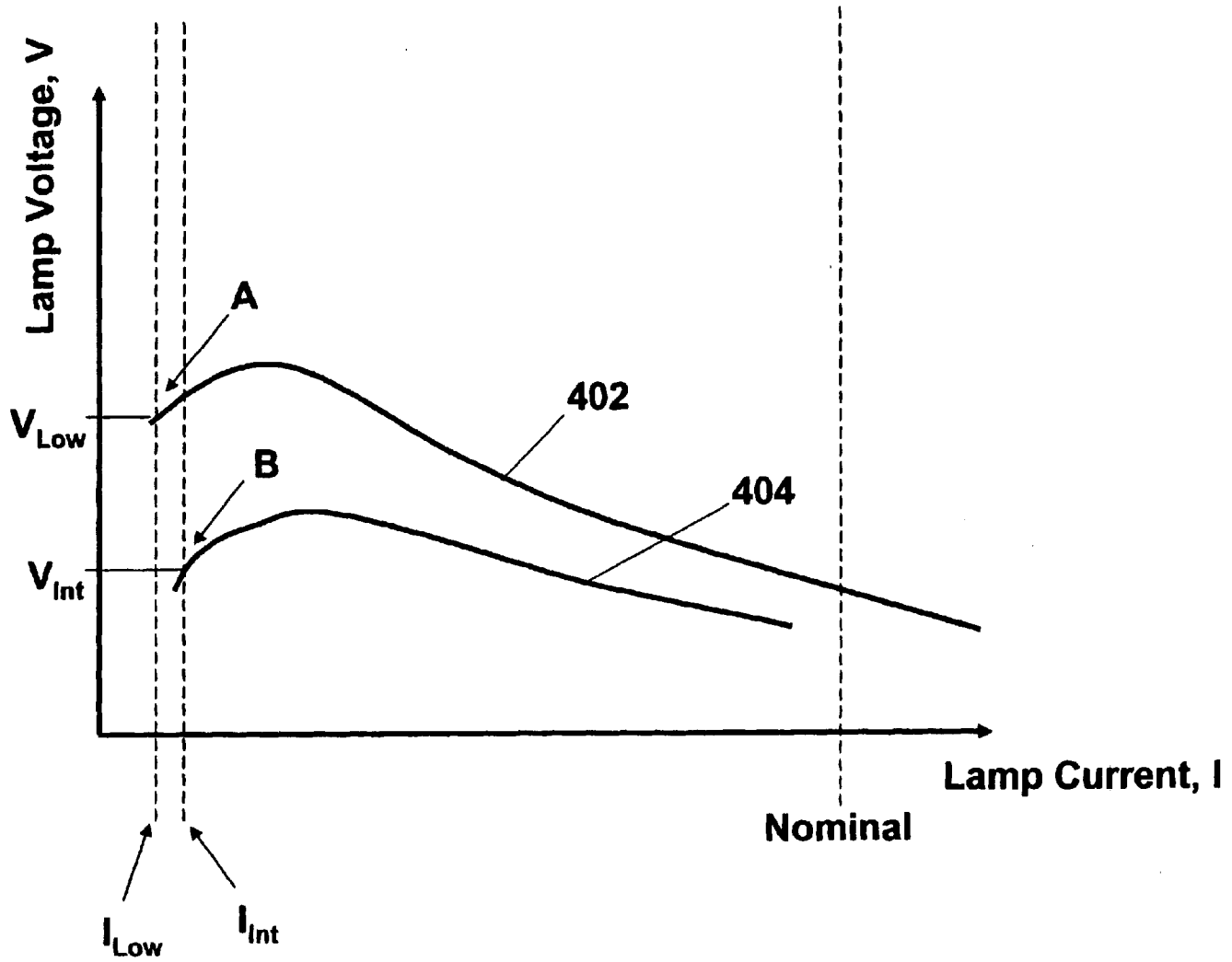
FIG. 4 is a plot of the voltage versus current (V-I) characteristics of a fluorescent lamp for different operating temperatures in accordance with an exemplary the present invention.

The lamp light output level of the lamp 208 can be controlled by several means. For example, the lamp light output level of the lamp 208 can be controlled by controlling the value of the lamp arc voltage provided to the lamp 208 via the terminals 207*a*, 207*b*, by controlling the value of the lamp arc current provided to the lamp 208 via the terminals 207*a*, 207*b*, by controlling the lamp arc power, or a combination thereof FIG. 4 is a plot of the voltage versus current (V-I) characteristics of a fluorescent lamp for different temperatures. Curves 402 and 404 represent the V-I characteristics for a fluorescent lamp operating at different temperatures. The curve 402 represents a lower operating temperature than curve 404. For example, the curve 402 could represent an operating temperature of 10 degrees C., and the curve 404 could represent an operating temperature of 140 degrees C. V-I curves for temperatures between 10 degrees C. and 140 degrees C. would fall in between curves 402 and 404. The V-I curve of a fluorescent lamp exhibits a steep slope forming a "cliff" (as depicted by arrow A for curve 402 and arrow B for curve 404) for which the lamp voltage falls rapidly from the peak of the curve to a zero value for an incrementally small decrease in the lamp current as the lamp is dimmed to below about one percent of nominal light output. In other words, the lamp tends to "drop out", that is, extinguishes, as one attempts to reduce lamp current to levels corresponding to a light output level below about one percent nominal light output. Operating close to this drop out point tends to cause flickering. Accordingly, it is desirable to reduce the lamp current level as low as possible without "falling off of the cliff", that is, operating in the region of steep positive slope of the V-I curve below the peak. Below this point is where the lamp is most sensitive to system perturbations which cause drop outs and lamp flickering. Note that the family of V-I curves for a particular lamp tend to be asymptotic at the high current end. Thus, operation of the lamp at its nominal light output level is not as perturbed by temperature fluctuations as at the low current/voltage end of the V-I curve.

In accordance with an exemplary embodiment of the present invention, when a request to dim the lamp to approximately 1% of its nominal light output level is received, the lamp is operated at an intermediate light output level until the lamp cools down. An exemplary scenario is described with reference to FIG. 4. Assume a lamp is operating at its nominal light output level. This corresponds to the coordinates on the V-I curve associated with the nominal current and voltage (dashed line labeled nominal indicates nominal lamp arc current). Also, the lamp is at the temperature associated with its nominal light output level, which is depicted by the curve 404. A request to dim the lamp to the low light output value (e.g., 1% of the nominal value) is received. That implies that the lamp is being requested to operate at the coordinates associated with the lamp arc current labeled $I_{Low}$. However, if the lamp arc current is adjusted to the value of $I_{Low}$, at a temperature resulting in the curve 404, the lamp will be operating in an unstable area. This will result in annoying flicker. Thus, in accordance with an exemplary embodiment of the present invention, the lamp is adjusted to operate at the operating coordinates associated with $I_{Int}$ (e.g., 2% to 5% of the nominal value of lamp arc current) until the temperature of the lamp cools to below a threshold temperature value. As shown in FIG. 4, the coordinates associated with $I_{Int}$ and the curve 404 are in a stable region of operation, thus reducing or eliminating flicker. Once the lamp cools down, the V-I curve resembles curve 402, rather than curve 404. The lamp arc current is then adjusted to the value of $I_{Low}$ from its current value of $I_{Int}$. Now that the lamp has cooled down, the operating V-I curve more closely resembles curve 402, and the lamp is now in a stable region of operation.

Figure 5:
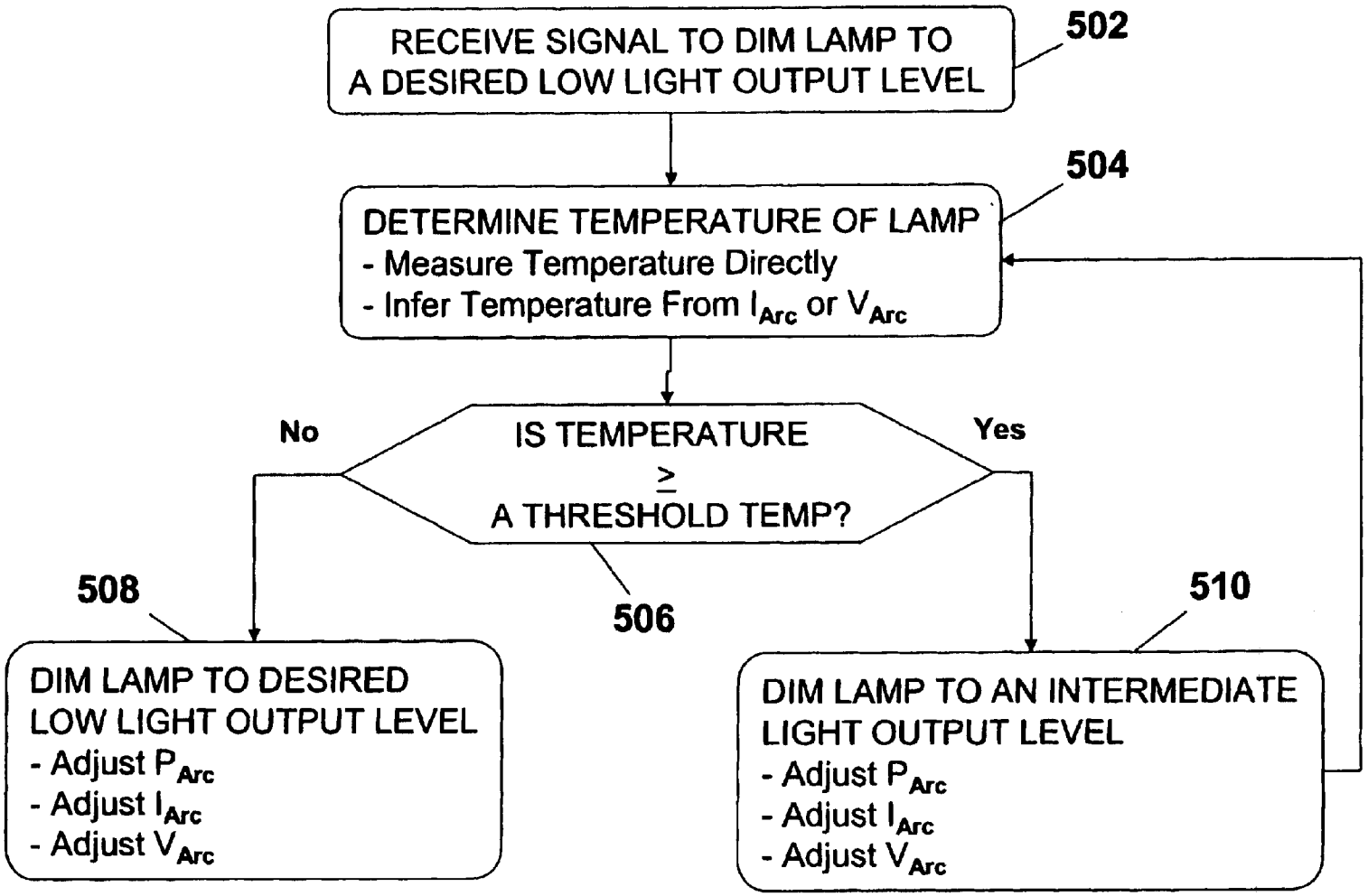
FIG. 5 is a flow diagram of a process for stably dimming a lamp light output level of a gas discharge lamp to a low lamp light output level without observable flicker in accordance with an exemplary embodiment of the present invention.

FIG. 5 is a flow diagram of an exemplary process for stably dimming a lamp light output level of a gas discharge lamp to a low lamp light output level without observable flicker in accordance with an embodiment of the present invention. A request to dim a gas discharge lamp (e.g., lamp 208) to a low light output level is received at step 502. This request can be provided by any appropriate mechanism, such as the dimming control 216, for example. The temperature of the lamp is determined at step 504. As previously described, the temperature of the lamp can be directly measured (e.g., utilizing temperature sensor 240), or can be inferred via the lamp arc current, $I_{Arc}$, or the lamp arc voltage, $V_{Arc}$. Those skilled in the art are knowledgeable of several means for inferring the lamp temperature. For example, utilizing the V-I curve for the particular lamp, $I_{Arc}$ can be determined if $V_{Arc}$ is known, and $V_{Arc}$ can be calculated if $I_{Arc}$ is known.

The lamp temperature is compared to the threshold temperature at step 506. For example, a fluorescent lamp operating at its nominal light output level can reach a temperature of approximately 120 degrees C. A fluorescent lamp operating at approximately 5% of its nominal light output level will maintain a temperature of approximately 30 to 40 degrees C. Thus, in an exemplary embodiment of the present invention, the threshold temperature value is a temperature within the range of approximately 80 to 100 degrees C. If the lamp temperature is less the than the threshold temperature (step 506), the lamp is dimmed to the requested low lamp light output level at step 508. If the lamp temperature is greater than or equal to the threshold temperature (step 506), the lamp is dimmed to the intermediate lamp light output level at step 510. The intermediate lamp light output level can be any appropriate level at which the lamp is stable and perceptibly flicker free. Also, it is advantageous if the intermediate lamp light output level is close enough to the low lamp light output level such that when the lamp light output level is reduced from intermediate to low, the change is not perceptible. As described previously, the lamp light output level can be controlled by adjusting the lamp arc voltage, by adjusting the lamp arc current, by adjusting the lamp arc power, or a combination thereof.

Figure 6:
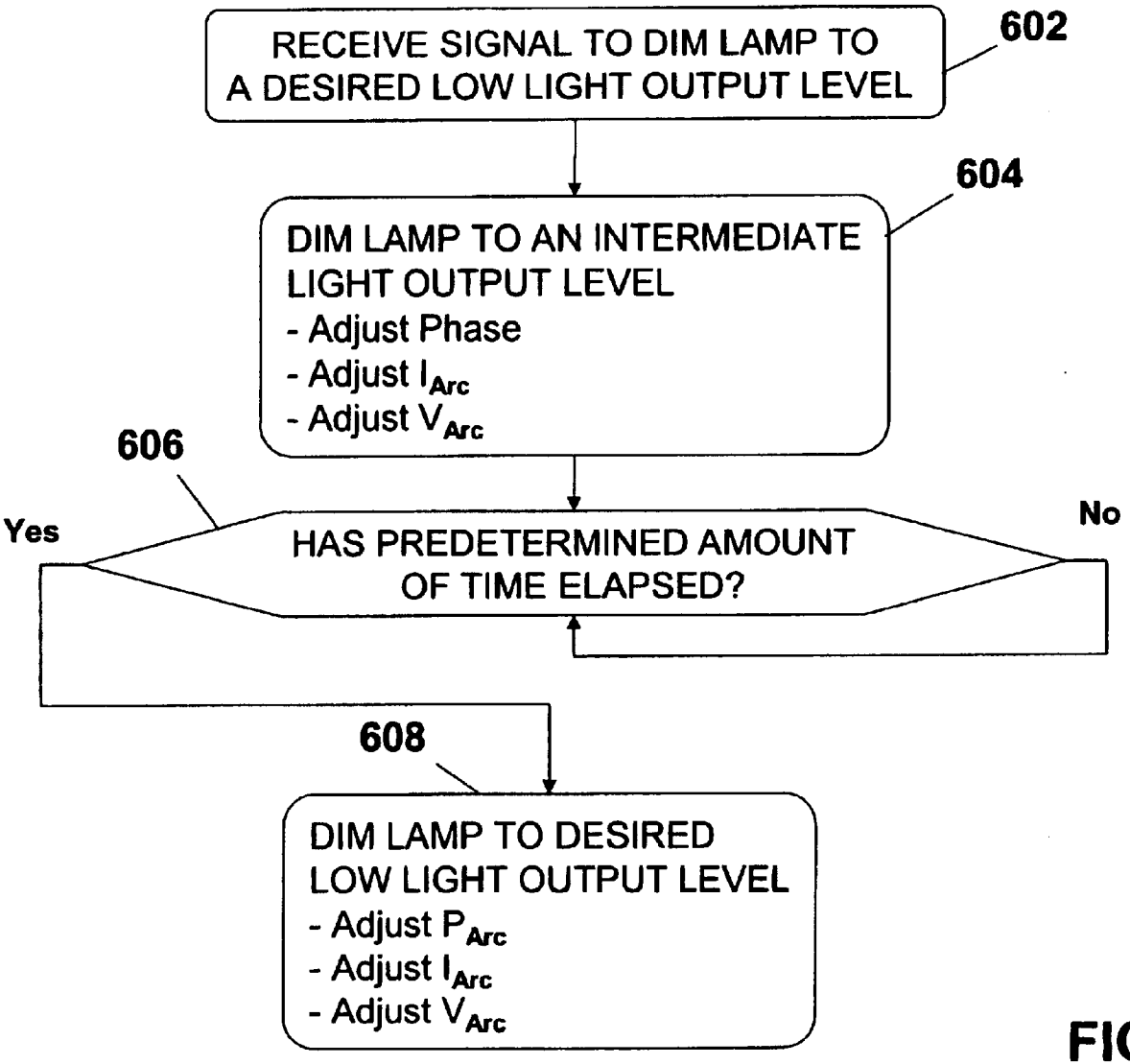
FIG. 6 is a flow diagram of another process for stably dimming a lamp light output level of a gas discharge lamp to a low lamp light output level without observable flicker in accordance with an exemplary embodiment of the present invention.

FIG. 6 is a flow diagram of another exemplary process for stably dimming a lamp light output level of a gas discharge lamp to a low lamp light output level without observable flicker in accordance with an embodiment of the present invention. The process depicted in FIG. 6 performs similarly to the process depicted in FIG. 5, except that rather than determining the temperature of the lamp and comparing that temperature to a threshold temperature, the lamp is operated at the intermediate light output level for a predetermined amount of time, and then operated at the low light output level. The predetermined amount of time is sufficient to allow the lamp to cool to a temperature that will allow stable operation of the lamp. Thus, rather than the measuring/inferring the lamp parameters of temperature, lamp arc voltage, or lamp arc current and comparing them to respective threshold lamp parameters of temperature, lamp arc voltage, and lamp arc current, the lamp is operated at the intermediate light output level for a predetermined amount of time (e.g., 5 minutes).

A request to dim a gas discharge lamp (e.g., lamp 208) to a low light output level is received at step 602. The lamp is dimmed to the intermediate lamp light output level at step 604. The lamp is maintained at the intermediate lamp light output level for the predetermined amount of time at step 606. When the predetermined amount of time has elapsed, the lamp is dimmed to the requested low lamp light output level at step 608.

A method for stably dimming a lamp light output level of a gas discharge lamp to a low lamp light output level without observable flicker as described herein may be embodied in the form of computer-implemented processes and system for practicing those processes. A method for stably dimming a lamp light output level of a gas discharge lamp to a low lamp light output level without observable flicker as described herein may also be embodied in the form of computer program code embodied in tangible media, such as floppy diskettes, read only memories (ROMs), CD-ROMs, hard drives, high density disk, or any other computer-readable storage medium, wherein, when the computer program code is loaded into and executed by a computer, the computer becomes a system for practicing the invention. The method for stably dimming a lamp light output level of a gas discharge lamp to a low lamp light output level without observable flicker as described herein may also be embodied in the form of computer program code, for example, whether stored in a storage medium, loaded into and/or executed by a computer, or transmitted over some transmission medium, such as over the electrical wiring or cabling, through fiber optics, or via electromagnetic radiation, wherein, when the computer program code is loaded into and executed by a computer, the computer becomes a system for practicing the invention. When implemented on a general-purpose processor, the computer program code segments configure the processor to create specific logic circuits.

While embodiments of the present invention has been described in connection with the exemplary embodiments of the various figures, it is to be understood that other similar embodiments may be used or modifications and additions may be made to the described embodiment for performing the same function of the present invention without deviating therefrom. Furthermore, it should be emphasized that a variety of computer platforms, including handheld device operating systems and other application specific operating systems are contemplated, especially as the number of wireless networked devices continues to proliferate. Therefore, the present invention should not be limited to any single embodiment, but rather should be construed in breadth and scope in accordance with the appended claims.

Although the present invention is described for use with compact fluorescent lamps, the circuits herein described may control any type of gas discharge lamp. Since certain changes may be made in the above described circuits without departing from the scope of the invention herein involved, it is intended that all matter contained in the above description or shown in the accompanying drawings shall be interpreted in an illustrative and not a limiting sense.

The invention may be embodied in the form of appropriate computer software, or in the form of appropriate hardware or a combination of appropriate hardware and software without departing from the spirit and scope of the present invention. Further details regarding such hardware and/or software should be apparent to the relevant general public. Accordingly, further descriptions of such hardware and/or software herein are not believed to be necessary.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed is:

1. A ballast for stably dimming a lamp light output level of a gas discharge lamp to a low lamp light output level without observable flicker, said ballast comprising:

a comparator circuit for:

comparing a measure signal indicative of a measured value of a lamp parameter with a threshold signal indicative of a threshold value of said lamp parameter; and providing a compare signal indicative of said comparison; and a clamp circuit for:

receiving said compare signal; and providing a clamp signal indicative of a result of said comparison; and a control circuit for:

receiving said clamp signal; and in accordance with said clamp signal, reducing the lamp light output level to an intermediate lamp light output level and subsequently reducing the lamp light output level to the low lamp light output level.

2. A ballast in accordance with claim 1, wherein said gas discharge lamp is a compact gas discharge lamp having at least one small radius allowing said compact gas discharge lamp to fold back on itself.

3. A ballast in accordance with claim 1, wherein:

said measured lamp parameter is a value of elapsed time; and said threshold lamp parameter is a predetermined amount of time.

4. A ballast in accordance with claim 1, wherein:

said lamp parameter is indicative of a lamp arc voltage of said lamp;

said lamp light output level is reduced to said low lamp light output level if the measured value of the lamp parameter is greater than or equal to the threshold value of the lamp parameter; and said lamp light output level is reduced to said intermediate lamp light output level if the measured value of the lamp parameter is less than the threshold value of the lamp parameter.

5. A ballast in accordance with claim 4, wherein:

said lamp light output level is reduced to said intermediate lamp light output level and subsequently reduced to said low lamp light output level is response to said measured value of the lamp parameter becoming greater than or equal to the threshold value of the lamp parameter.

6. A ballast in accordance with claim 1, wherein:

said lamp parameter is indicative of one of a temperature of said lamp, a lamp arc current of said lamp, and a lamp arc power of said lamp;

said lamp light output level is reduced to said low lamp light output level if the measured value of the lamp parameter is less than the threshold value of the lamp parameter; and said lamp light output level is reduced to said intermediate lamp light output level if the measured value of the lamp parameter is greater than or equal to the threshold value of the lamp parameter.

7. A ballast in accordance with claim 6, wherein:

said lamp light output level is reduced to said intermediate lamp light output level and subsequently reduced to said low lamp light output level is response to said measured value of the lamp parameter becoming less than the threshold value of the lamp parameter.

8. A ballast in accordance with claim 1, wherein said low lamp light output level is equal to or less than approximately 1 percent of a full rated lamp light output level.

9. A ballast in accordance with claim 1, wherein said intermediate lamp light output level is within a range of greater than 1 percent to approximately 5 percent of a full rated lamp light output level.

10. A ballast in accordance with claim 1, wherein reducing the lamp light output level comprises decreasing a value of minimum lamp arc current.

11. A ballast in accordance with claim 1, wherein said lamp light output level is controlled by controlling at least one of a lamp arc voltage, a lamp arc current, and a lamp arc power.

12. A light fixture for stably dimming a lamp light output level of a gas discharge lamp to a low lamp light output level without observable flicker, said light fixture comprising:

a ballast comprising:

a comparator circuit for:

comparing a measure signal indicative of a measured value of a lamp parameter with a threshold signal indicative of a threshold value of said lamp parameter; and providing a compare signal indicative of said comparison; and a clamp circuit for:

receiving said compare signal; and providing a clamp signal indicative of a result of said comparison; and a control circuit for:

receiving said clamp signal; and in accordance with said clamp signal, reducing the lamp light output level to an intermediate lamp light output level and subsequently reducing the lamp light output level to the low lamp light output level.

13. A light fixture in accordance with claim 12, wherein said gas discharge lamp is a compact gas discharge lamp having at least one small radius allowing said compact gas discharge lamp to fold back on itself.

14. A light fixture in accordance with claim 12, wherein:

said measured lamp parameter is a value of elapsed time; and said threshold lamp parameter is a predetermined amount of time.

15. A light fixture in accordance with claim 12, wherein:

said lamp parameter is indicative of a lamp arc voltage of said lamp;

said lamp light output level is reduced to said low lamp light output level if the measured value of the lamp parameter is greater than or equal to the threshold value of the lamp parameter; and said lamp light output level is reduced to said intermediate lamp light output level if the measured value of the lamp parameter is less than the threshold value of the lamp parameter.

16. A light fixture in accordance with claim 15, wherein:

said lamp light output level is reduced to said intermediate lamp light output level and subsequently reduced to said low lamp light output level in response to said measured value of the lamp parameter becoming greater than or equal to the threshold value of the lamp parameter.

17. A light fixture in accordance with claim 12, wherein:

said lamp parameter is indicative of one of a temperature of said lamp, a lamp arc current of said lamp, and a lamp arc power of said lamp;

said lamp light output level is reduced to said low lamp light output level if the measured value of the lamp parameter is less than the threshold value of the lamp parameter; and said lamp light output level is reduced to said intermediate lamp light output level if the measured value of the lamp parameter is greater than or equal to the threshold value of the lamp parameter.

18. A light fixture in accordance with claim 17, wherein:

said lamp light output level is reduced to said intermediate lamp light output level and subsequently reduced to said low lamp light output level in response to said measured value of the lamp parameter becoming less than the threshold value of the lamp parameter.

19. A light fixture in accordance with claim 12, wherein said low lamp light output level is equal to or less than approximately 1 percent of a full rated lamp light output level.

20. A light fixture in accordance with claim 12, wherein said intermediate lamp light output level is within a range of greater than 1 percent to approximately 5 percent of a full rated lamp light output level.

21. A light fixture in accordance with claim 12, wherein reducing the lamp light output level comprises decreasing a value of minimum lamp arc current.

22. A light fixture in accordance with claim 12, wherein said lamp light output level is controlled by controlling at least one of a lamp arc voltage, a lamp arc current, and a lamp arc power.

* * * * *